United States Patent [19]

Hamu

[11] 3,962,805

[45] June 15, 1976

[54] GRIPPING DEVICE

[76] Inventor: Kaino Johannes Hamu, 18421 Santa Belinda Circle, Fountain Valley, Calif. 92708

[22] Filed: May 22, 1975

[21] Appl. No.: 580,068

[52] U.S. Cl. ..... 38/102.5; 101/127.1; 160/371

[51] Int. Cl.[2] ..... D06C 3/08

[58] Field of Search ..... 160/371, 392–397; 38/102–102.91; 101/127.1; 24/243 K, 243 L, 243 M, 243 N

[56] References Cited

UNITED STATES PATENTS

| | | | |
|---|---|---|---|
| 2,119,667 | 6/1938 | Crowe | 160/392 X |
| 2,588,199 | 3/1952 | Bily | 101/127.1 |
| 3,141,221 | 7/1964 | Faulls | 24/243 M |
| 3,393,637 | 7/1968 | Wassmann et al. | 101/127.1 |
| 3,818,550 | 6/1974 | Cresswell | 24/243 K |

*Primary Examiner*—G. V. Larkin

*Attorney, Agent, or Firm*—Boniard I. Brown

[57] ABSTRACT

A gripping device for thin flexible sheet material comprises a channel member having a longitudinal channel of tapered cross-section opening laterally along its narrow side through one side of the member and containing a gripper bar of generally similar tapered cross-section which is movable laterally toward the open channel side to a gripping position wherein the bar is disposed in wedging relation between and restrained against rotation about its longitudinal axis by the channel side walls. Sheet material to be gripped is inserted through the channel and about the inner side of the gripper bar between the latter and the channel walls in such a way that a tension force on the sheet material draws the bar to its gripping position to effect gripping of the sheet material between the channel side walls and longitudinal gripping surfaces along the sides of the bar. The gripping device described is an anchor bar for a silk screen printing frame or screen chase.

11 Claims, 7 Drawing Figures

GRIPPING DEVICE

BACKGROUND OF THE INVENTION

1. Field of the Invention

This invention relates generally to handling devices for a flexible sheet material and more particularly to a novel gripping device for such sheet material.

2. Prior Art

As will appear from the ensuing description, the sheet gripping device of the invention may be utilized for a variety of sheet gripping applications. However, the gripping device is intended primarily for use as a screen anchor bar for a silk screen printing frame, or screen chase as it is referred to in the silk screen printing industry. The invention will be described in connection with this particular application.

Simply stated, a screen chase comprises a rectangular frame having a central opening bounded by four frame members forming the four sides of the frame, and a printing screen overlying the frame and secured along its edges to screen anchor bars carried by the frame members. These anchor bars include gripping means for gripping the screen edges and are adjustable laterally relative to their respective frame members for biaxially stressing the printing screen. The gripping means are releasable to permit removal and replacement of the screen.

The prior art is replete with a vast assortment of such silk screen printing chases. Included in this prior printing chase art are my U.S. Pat. Nos. 3,482,343 and 3,553,862, and the following additional U.S. Pat. Nos. 2,803,086; 2,854,922; 2,893,162; 3,422,554, Belgian Pat. No. 519,040.

This invention is concerned with improving the anchor bar screen gripping means of silk screen printing chases of the character described, particularly those which utilize cylindrical screen gripper bars or rods such as described in my U.S. Pat. No. 3,553,862. This latter type of gripping means comprises cylindrical gripper rod means, which may be a single gripper rod or multiple rods as described in my patent, contained within a longitudinal channel in an anchor bar. The printing screen is inserted through the channel and around the gripper rod means in such a way that tension in the screen draws the rod means to a gripping position in the channel wherein the rod means is disposed in wedging relation between the channel side walls and the screen is gripped between the side walls and the rod means. While this type of gripping means is suitable for many printing chase applications, it has the disadvantage that the screen tension, which acts tangentially of the gripper rod means, tends to rotate the latter and thereby cause release of the screen tension. Other types of existing screen gripping means tend to be complicated, costly, and/or difficult to manipulate to effect gripping of a screen.

SUMMARY OF THE INVENTION

According to its more limited aspects, this invention provides an anchor bar for a silk screen printing chase embodying improved screen gripping means which avoids the above noted and other disadvantages of the existing screen gripping means. As noted earlier, however, the invention is not limited to this silk screen printing application. Thus, in its broader aspects the invention is concerned with an improved sheet gripping device for gripping any type of thin flexible sheet material for any purpose.

This improved gripping device comprises a channel member having a longitudinal channel of tapered cross-section which opens laterally along its narrow side through one side of the channel member. Contained within this tapered channel is a gripper bar of generally similar tapered cross-section having longitudinal gripping surfaces facing the channel side walls. This gripper bar is movable laterally outward in the channel toward the open channel side to a gripping position wherein the bar is disposed in wedging relation between and is positively restrained against rotation on its longitudinal axis by the channel side walls.

The printing screen or other thin flexible sheet material to be gripped is inserted through the channel and around the inner side of the gripper bar, between the latter and the channel walls in such a way that tension in the material draws the bar outwardly to its gripping position. In this position, the sheet material is firmly gripped between the longitudinal gripping surfaces on the bar and the channel side walls. Since the bar is restrained against turning by the channel side walls, the disadvantage, mentioned earlier, of the existing printing screen gripping devices with cylindrical gripper rods is avoided, and the present improved gripping means is effective to maintain the tension in the sheet material.

In the preferred form of the invention, one gripping surface of the gripper bar is flat and its other gripping surface has a rounded bead-like configuration. This rounded gripping surface acts as a fulcrum about which the gripper bar is rockable to locate its flat gripping surface in parallel relation to the adjacent channel side wall. In a second described form of the invention, both gripping surfaces of the gripper bar are flat and are disposed at the same included angle as the channel side walls. These described gripping devices are anchor bars for a silk screen printing chase.

DESCRIPTION OF THE PREFERRED EMBODIMENT

Figures 1, 2, 3, 4, 5, 6, 7:
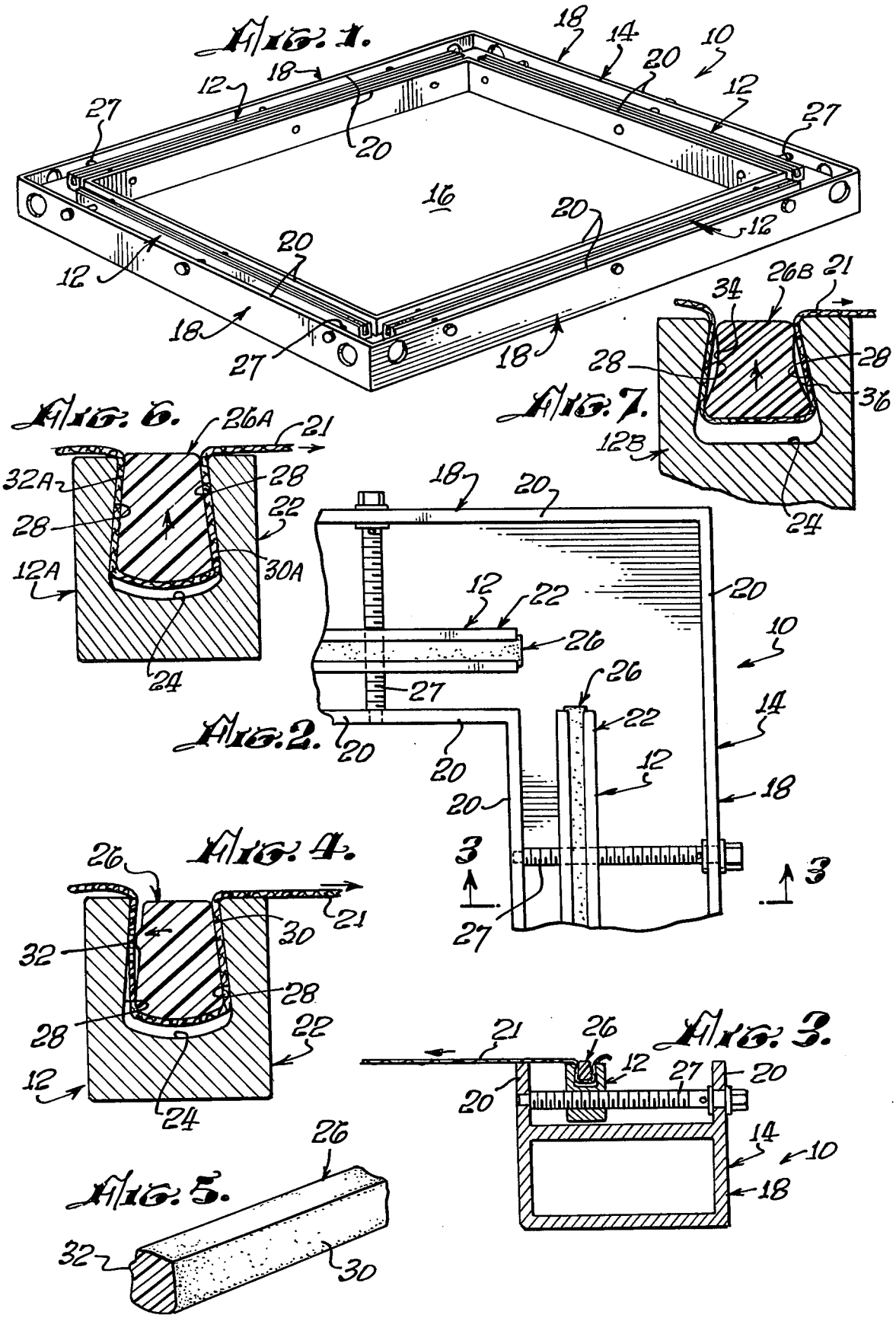
FIG. 1 is a perspective view of a silk screen printing chase frame structure embodying improved sheet gripping devices or screen anchor bars according to the invention.
FIG. 2 is an enlarged top view of one corner of the frame structure in FIG. 1.
FIG. 3 is a section taken on line 3—3 in FIG. 2.
FIG. 4 is an enlarged section through one of the improved anchor bars in the structure of FIGS. 1–3.
FIG. 5 is a fragmentary perspective view of the gripper bar of the anchor bar in FIG. 4.
FIG. 6 is a section similar to FIG. 4 through a modified screen anchor bar according to the invention.
FIG. 7 is a section similar to FIG. 4 through another modified form of screen anchor bar according to the invention.

Referring first to FIGS. 1–3, the illustrated silk screen printing chase frame structure 10 is essentially identical, except for its improved screen gripping devices or anchor bars 12, to that described in my prior U.S. Pat. No. 3,553,862. This frame structure comprises, in addition to the anchor bars 12, an open rectangular frame 14 having a central rectangular opening 16 bounded along its four sides by frame members 18. These frame members are rigidly joined at the corners of the frame. As shown best in FIG. 3, each frame member 18 has a box channel section with upstanding flanges 20 along the inner and outer longitudinal sides of the member. The printing screen of the screen chase is placed across the top of the frame structure 10 and its edges are secured to the anchor bars 12 which are then adjusted to stretch the screen in both edgewise directions, as explained later. This screen is not shown in FIGS. 1 and 2 but is shown at 21 in FIGS. 3 and 4.

An anchor bar 12 of this invention is located between the flanges 20 of each frame member 18. Referring particularly to FIG. 6, each anchor bar includes a channel member 22 having a longitudinal channel 24 containing a gripper bar 26. The channel member 22 of each anchor bar 12 is supported on the flanges 20 of its respective frame member 18 by screws 27 which extend through the flanges and channel member. Each screw is rotatable in and axially restrained by the flanges and is threaded in the corresponding channel member, such that each anchor bar 12 is laterally adjustable inwardly and outwardly relative to the frame member 18 by rotatable adjustment of its screws. As shown best in FIG. 3, each anchor bar channel member 22 has a normally upper longitudinal surface substantially coplanar with the upper edges of its frame flanges 20. All of these upper flange edges, in turn, are located in a common plane parallel to the plane of the frame member 18.

Turning now to FIGS. 4 and 5, each anchor bar channel member 22 has a rectangular cross-section. The channel 24 of each member is tapered in transverse cross-section and opens laterally through the upper surface of the member. The side walls 28 of the channel converge toward one another and toward the intervening longitudinal medial plane of the channel normal to and containing the longitudinal centerline of the open channel side in the upward direction toward the open channel side. Accordingly, the channel narrrows toward its open side.

The gripper bar 26 has a taper in transverse cross-section similar to the taper of the channel 24 and, at its opposite longitudinal sides, gripping surfaces 30 and 32. Gripping surface 30 is flat and is inclined at the same angle relative to the longitudinal medial plane of the channel as the adjacent channel side wall 28. Gripping surface 32 has a rounded bead-like configuration and protrudes outwardly from and extends lengthwise of the adjacent tapered side of the gripper bar between its upper and lower sides.

Gripper bar 26 is movably laterally outward, i.e., upward, in the channel 24, toward the open channel side, to its gripping position of FIG. 4. In this position, the gripper bar is disposed in screen gripping relation between the channel side walls 28 and is rockably supported by the rounded gripping surface 32, which acts as a fulcrum, on the adjacent channel side wall to locate its flat gripping face 30 parallel to the other channel side wall. The gripper bar is movable laterally inward or downward in the channel to a screen releasing position.

As noted earlier, the printing screen 21 of the screen chase is placed over the top of the frame structure 10 and is secured along its edges to the anchor bars 12. Referring to FIG. 4, each edge of the screen is secured to the adjacent anchor bar by inserting the screen through the channel 24 of the anchor bar channel member 22 and around the under side of its gripper bar 26, between the channel side walls 28 and the gripping surfaces 30, 32 of the gripper bar. With the screen thus inserted through the channel, tension in the screen, in the direction of the arrow in FIG. 4, draws the gripper bar outwardly or upwardly in its tapered containing channel to its gripping position wherein the gripper bar is disposed in wedging relation between the channel side walls to effect gripping of the screen between the side walls and the gripping surfaces 30, 32 of the gripper bar. As the gripper bar enters this gripping position, it rocks about its rounded gripping surface 32 as a fulcrum to locate its flat gripping surface 30 parallel to the adjacent channel side wall for firmly gripping therebetween the intervening portion of the screen 21. If desired, the gripping surface 30 and/or the gripping surface 32 and channel side walls may be serrated or grooved to enhance the gripping action.

It is significant to note here that the gripper bars 26 have a lateral dimension greater than the width of the open sides of their containing channels 24, such that the bars are laterally caged in the channels. The bars are insertable and removable endwise into and from the channels through the open ends of the channels and aligned openings 34 in the frame members 18. According to the preferred practice of securing the edges of the printing screen 21 to the anchor bars 12, the gripper bars 26 are removed, the screen edges are tucked or folded into the anchor bar channels 24, and the gripper bars are reinserted into the channels through the screen folds in the channels. The screen is removed by reversing this procedure. The lateral width of each gripper bar 26 between the outer extremity of its gripping surface 32 and the laterally opposite portion of gripping surface 30 is such that the upper or outer side of the bar is substantially flush, in its gripping position, with the upper side of its channel member 22.

It is now apparent that the printing screen 21 is installed on the frame structure 10, to form a silk screen printing chase by adjusting the anchor bars 12 laterally inward, placing the screen across the frame and engaging the screen edges with the anchor bars in the manner explained above, and then adjusting the anchor bars laterally outward to effecting gripping of the screen by the anchor bars and tensioning of the screen. The screen in removed by reversing this procedure.

The modified anchor bar 12A of FIG. 6 is identical to the anchor bar 12 except that both gripping surfaces 30A, 32A of its gripper bar 26A are flat and disposed at the same included taper angle as the side walls of 28 of the anchor bar channel member 22. In this embodiment, the printing screen 21 is gripped between the channel side walls and the flat gripping surfaces of the gripper bar which parallel the side walls.

FIG. 7 shows another modified form of the anchor bar according to the invention, which is similar to anchor bar 12, except that the side walls 34, 36 of its gripper bar 26B are relieved or concave between the inner and outer corner edges of the bar, as shown. The printing screen is gripped between the channel side walls and the inner and outer end portions of the side walls.

In each form of the anchor bar, the inner or lower surface and corner edges of the gripper bar are rounded to avoid cutting and wear of the printing screen. Again recalling the earlier discussion, it will be understood that while the invention has been described in connection with an anchor bar for a screen printing frame, the features of the invention may be embodied in a sheet or film gripping device for other purposes.

The inventor claims:

1. A gripping device for thin flexible sheet material comprising:

an elongate channel member containing a longitudinal channel of tapered cross-section opening laterally along its narrow side through one side of said member, said channel having longitudinal side walls which converge toward the open side of said channel, a gripper bar of substantially fixed tapered cross-section within said channel having longitudinal gripping surfaces along its opposite sides facing said channel side walls, respectively, at least one of said gripping surfaces being flat and normally paralleling the adjacent channel side wall, said gripper bar having a wide side with a lateral dimension exceeding the width of said open channel side and said gripper bar being movable laterally outward toward said open channel side to a gripping position wherein said bar is wedged between said channel side walls and said gripping surfaces of the bar are disposed in sheet gripping relation to said channel side walls, and said channel is adapted to receive said sheet material in a manner such that the sheet material extends through said channel and around said gripper bar between the latter and the channel walls, whereby stress in the sheet material draws the gripper bar outwardly to said gripping position to effect gripping of the sheet material between said gripper bar surfaces and said channel side walls.

2. A gripping device according to claim 1 wherein:

said channel has a longitudinal medial plane transverse to the plane of and containing the longitudinal centerline of said open channel side, and said one channel side wall converges toward said medial plane in the direction of said open channel side.

3. A gripping device according to claim 1 wherein:

said channel has a longitudinal medial plane transverse to the plane of and containing the longitudinal centerline of said open channel side, and each of said channel side walls converges toward said medial plane in the direction of said open channel side.

4. A gripping device according to claim 1 wherein:

said channel has a longitudinal medial plane transverse to the plane of and containing the longitudinal centerline of said open channel side, each of said channel side walls converges toward said medial plane in the direction of said open channel side, and the other gripper bar surface comprises a rounded bead-like formation protruding beyond the adjacent side of said gripper bar to form a fulcrum about which said bar is adapted to rock and align said flat gripper bar surface parallel to the adjacent channel side wall.

5. A gripping device according to claim 1 wherein:

the other gripper bar surface comprises a rounded bead-like formation protruding beyond the adjacent side of said gripper bar to form a fulcrum about which said bar is adapted to rock and align said flat gripper bar surface parallel to the adjacent channel side wall.

6. A gripping device according to claim 1 wherein:

the other gripper bar surface is flat and normally parallels the adjacent channel side wall.

7. A gripping device according to claim 1 wherein:

at least one of said longitudinal gripping surfaces of the gripper bar is concave.

8. A gripping device according to claim 7 wherein:

said channel has a longitudinal medial plane transverse to the plane of and containing the longitudinal centerline of said open channel side, and said one channel side wall converges toward said medial plane in the direction of said open channel side.

9. A gripping device according to claim 7 wherein:

said channel has a longitudinal medial plane transverse to the plane of and containing the longitudinal centerline of said open channel side, and each of said channel side walls converges toward said medial plane in the direction of said open channel side.

10. A gripping device according to claim 1 wherein:

said channel opens through at least one end of said channel member to permit removal and insertion of said gripper bar endwise from and into said channel.

11. A gripping device according to claim 1 wherein:

said gripping device is a screen anchor bar for a silk screen printing chase.

* * * * *